US005299918A

United States Patent [19]

Teruo

[11] Patent Number: 5,299,918

[45] Date of Patent: Apr. 5, 1994

[54] BEARING FOR COMPRESSOR DRIVE SHAFT

[75] Inventor: Higuchi Teruo, Isesaki, Japan

[73] Assignee: Sanden Corporation, Gunma, Japan

[21] Appl. No.: 63,062

[22] Filed: May 19, 1993

Related U.S. Application Data

[63] Continuation of Ser. No. 868,423, Apr. 15, 1992, abandoned.

[30] Foreign Application Priority Data

Apr. 15, 1991 [JP] Japan ..... 3-108122

[51] Int. Cl.[5] ..... F04B 27/08

[52] U.S. Cl. ..... 417/269; 417/222.1; 92/71

[58] Field of Search ..... 417/222 R, 222 S, 269, 417/270; 92/12.2, 71; 74/60

[56] References Cited

U.S. PATENT DOCUMENTS

| | | | |
|---|---|---|---|
| 2,672,819 | 3/1954 | Widmer | 417/269 |
| 2,991,723 | 7/1961 | Zubaty | 417/269 |
| 3,823,557 | 7/1974 | Van Wagenen et al. | 417/269 X |
| 4,492,527 | 1/1985 | Swain et al. | 92/12.2 X |
| 4,776,260 | 10/1988 | Vincze | 417/269 X |
| 5,061,155 | 10/1991 | Masaoka et al. | 417/269 |
| 5,092,741 | 3/1992 | Taguchi | 417/222 S |

FOREIGN PATENT DOCUMENTS

| | | | |
|---|---|---|---|
| 259776 | 12/1985 | Japan | 417/222 S |

OTHER PUBLICATIONS

Bearing manual cyclopedia, vol. 2, No. 104, Industrial Information Headquarters, Inc., Broadview, Ill. 60153, 1981 pp. 957, 961, 964, 965, 969.

*Primary Examiner*—Richard A. Bertsch
*Assistant Examiner*—Peter Korytnyk
*Attorney, Agent, or Firm*—Baker & Botts

[57] ABSTRACT

A slant plate compressor with a variable displacement mechanism including a driving mechanism having a drive shaft is disclosed. The compressor includes a compressor housing having a cylinder block. A plurality of peripherally located cylinders are formed through the cylinder block. A piston is slidably fitted in each of the cylinders and is reciprocated by the driving mechanism. An inner end of the drive shaft is rotatably supported in the cylinder block by bearing which is fixedly disposed within a central bore formed through the cylinder block. Both rearward and radial forces acting on the drive shaft are effectively received and compensated for by the bearing without providing an axial position adjusting element, such as, a washer having the various thicknesses for adjusting an axial position of the drive shaft.

19 Claims, 5 Drawing Sheets

BEARING FOR COMPRESSOR DRIVE SHAFT

This application is a continuation of Ser. No. 07/868,423, filed Apr. 15, 1992, now abandoned.

BACKGROUND OF THE INVENTION

1. Field of the Invention

The present invention relates to a refrigerant compressor, and more particularly, to a slant plate type compressor with a variable displacement mechanism, such as a wobble plate type compressor with a variable displacement mechanism for use in an automotive air conditioning system.

2. Description of the Prior Art

FIG. 1 illustrates a wobble plate type compressor with a variable displacement mechanism as disclosed in U.S. Pat. No. 4,606,705 to Parekh et al. For purposes of explanation only, the left side of the figure will be referenced as the forward end or front and the right side of the figure will be referenced as the rearward end.

Compressor 100 includes compressor housing 101, cylinder block 102 having a plurality of cylinders 103 formed therein, driving mechanism 104 having drive shaft 105 and slant plate 106, wobble plate 107 which is rotatably mounted on slant plate 106 and nutates when drive shaft 105 and slant plate 106 rotate, and rotation preventing mechanism 108 which prevents rotation of wobble plate 107 during the nutational motion of wobble plate 107. Pistons 109 are slidably disposed in respective cylinders 103 and are connected to wobble plate 107 through respective connecting rods 110. The nutational motion of wobble plate 107 causes pistons 109 to reciprocate in respective cylinders 103 and thereby compress the refrigerant therein. Crank chamber 111 is defined by housing 101 and a front end of cylinder block 102. Suction chamber 112 is defined in housing 101 rear to cylinder block 102. Valve control mechanism 113 is disposed in housing 101 and controls the communication between crank chamber 111 and suction chamber 112 in response to changes in suction chamber pressure in order to vary crank chamber pressure. Changes in the crank chamber pressure varies the slant angle of slant plate 106 with respect to a plate perpendicular to the axis of drive shaft 105. In turn, changes in the slant angle of slant plate 106 varies the stroke length of each piston 109 so that the capacity of compressor 100 changes. Therefore, the capacity of compressor 100 is varied by the operation of valve control mechanism 113.

An inner front end of drive shaft 105 is rotatably supported by a front end of housing 101 through needle bearing **101*a*. Thrust needle bearing 101*b* surrounding drive shaft 105 is disposed between an inner end surface of the front end of housing 101 and a front end of annular cylindrical member 114 fixedly connected to drive shaft 105 by pin member 115. Thrust needle bearing 101*b* receives a forward force generated by the gas pressure reaction force of the compressed refrigerant in cylinders 103 as transmitted through pistons 109, connecting rods 110, wobble plate 107, slant plate 106, drive shaft 105 and annular cylindrical member 114**.

First annular groove **105*c* is formed in an outer peripheral surface of the inner rear end portion of drive shaft 105 in front of forward to cylinder block 102. Split ring return spring 116 is fixedly received in first annular groove 105*c* by snap portion 116*a*. When slant plate 106 reaches its minimum slant angle, it is contacted by return spring 116, and the restoring force of split ring return spring 116 urges it back towards greater slant angles. Therefore, when slant plate 106 contacts split ring return spring 116, a rearward force acting on drive shaft 105 is generated. The rearward force is increased in direct proportion to the increase in the restoring force of return spring 116. When the rearward force generated by the contact of slant plate 106 and return spring 116 becomes greater than the forward force generated by the gas pressure reaction force in cylinders 103, drive shaft 105** tends to move rearwardly.

Referring also to FIG. 2, drive shaft 105 includes small diameter portion **105*a* which is integral with and extends from an inner rear end of drive shaft 105, thereby forming annular ridge 105*b* at the inner rear end of drive shaft 105. Annular ridge 105*b* is located in front of cylinder block 102. Small diameter portion 105*a* of drive shaft 105 is rotatably supported by cylinder block 102 through needle bearing 102*a* which is fixedly disposed in central bore 117 formed through cylinder block 102. Needle bearing 102*a* is fixedly disposed in central bore 117** by, for example, forcible insertion.

Second annular groove **105*d* rearwardly extending from annular ridge 105*b* is formed in an outer peripheral surface of small diameter portion 105*a* of drive shaft 105. Washer 118 is slidably received in second annular groove 105*d*, and is sandwiched between annular ridge 105*b* and cylinder block 102 so as to prevent the rearward movement of drive shaft 105. The axial length of second annular groove 105*d* is designed to accommodate a washer 118 having a sufficiently large thickness. Washer 118 radially extends in order to contact the front end surface of cylinder block 102**.

When this prior art compressor is assembled, the clearance created between a side wall of annular ridge **105*b* of drive shaft 105 and the front end surface of cylinder block 102 is variable because of a variation in the tolerances of the compressor component parts. Therefore, the washer 118 that is selected has a thickness equal to or slightly smaller than the clearance created between the side wall of annular ridge 105*b* and the front end surface of cylinder block 102 in order to effectively prevent the rearward movement of drive shaft 105**.

However, as drive shaft 105 tends to move rearwardly, drive shaft 105 thrusts annular ridge **105*b* rearwardly through washer 118, which is selected to have a thickness equal to or slightly smaller than the clearance created between the side wall of annular ridge 105*b* and the front end surface of cylinder block 102. Therefore, washer 118 is compressedly sandwiched by cylinder block 102 and annular ridge 105*b* when drive shaft 105 tends to move rearwardly. As a result, washer 118 rotates relative to cylinder block 102 or drive shaft 105 and frictionally slides over the front end surface of cylinder block 102 or the side wall of annular ridge 105*b*. In a short period of time, the operation of the compressor causes an abnormal abrasion on the friction surface of the softer member of drive shaft 105 or washer 118, and the softer member of washer 118 or cylinder block 102**.

Accordingly, even though the thickness of washer 118 is appropriately selected during the assembling process of the compressor, a new clearance is created between the side wall of annular ridge **105*b* of drive shaft 105 and the front end surface of cylinder block 102 such that washer 118 may collide with the front end surface of cylinder block 102 and the side wall of annular ridge 105***b* of drive shaft 105. The collision between washer 118 and cylinder block 102 and annular ridge 105*b* causes an offensive noise.

Furthermore, if washer 118 is mistakenly selected such that the thickness thereof is smaller than the clearance created between the side wall of annular ridge 105*b* and the front end surface of cylinder block 102, washer 118 may also collide with the front end surface of cylinder block 102 and the side wall of annular ridge 105*b* of drive shaft 105 because washer 118 is slidably received in second annular groove 105*d*. In this instance, the collision between washer 118 and cylinder block 102 and annular ridge 105*b* also causes an offensive noise.

Still further, selecting a washer 118 that has a thickness equal to or slightly smaller than the clearance created between the side wall of annular ridge 105*b* and the front end surface of cylinder block 102 complicates the assembling process of the compressor.

FIG. 3 substantially illustrates the relevant part of a wobble plate type compressor with a variable displacement mechanism as sold in the commercial market. In the drawing, the same numerals are used to denote the corresponding elements shown in FIGS. 1 and 2 so that an explanation thereof is omitted.

In this prior art embodiment, thrust bearing 120 is slidably mounted about small diameter portion 105*a* of drive shaft 105 between the side wall of annular ridge 105*b* and the front end surface of cylinder block 102. Thrust bearing 120 radially extends so as to contact the front end surface of cylinder block 102. Thrust bearing 120 is selected such that the thickness thereof is equal to or slightly smaller than the clearance created between the side wall of annular ridge 105*b* of drive shaft 105 and the front end surface of cylinder block 102. Thrust bearing 120 effectively receives the rearward thrust force generated when drive shaft 105 tends to move rearwardly so that no abnormal abrasion occurs on the front end surface of cylinder block 102 or the side wall of annular ridge 105*b*.

However, the provision of a relatively expensive thrust bearing 120 causes an increase in the manufacturing cost of the compressor.

Furthermore, if thrust bearing 120 is mistakenly selected such that the thickness thereof is smaller than the clearance created between the side wall of annular ridge 105*b* and the front end surface of cylinder block 102, the associated drawbacks, such as the collision between thrust bearing 120 and cylinder block 102 and annular ridge 105*b*, will also occur as discussed above for Parekh et al.

Still further, selecting a thrust bearing 120 such that the thickness thereof is equal to or slightly smaller than the clearance created between the side wall of annular ridge 105*b* and the front end surface of cylinder block 102 complicates the assembling process of the compressor, as it also did in Parekh et al.

FIG. 4 substantially illustrates the relevant part of a wobble plate type compressor with a variable displacement mechanism as disclosed in Japanese Patent Application Publication No. 1-267374. In the drawing, the same numerals are used to denote the corresponding elements shown in FIGS. 1 and 2 so that an explanation thereof is omitted.

In this prior art embodiment, thrust bearing 120 and belleville spring 121 disposed rearward to thrust bearing 120 are mounted about small diameter portion 105*a* of drive shaft 105 between the side wall of annular ridge 105*b* and the front end surface of cylinder block 102. Thrust bearing 120 is slidably mounted about small diameter portion 105*a*. Spring 121 is compressedly sandwiched between thrust bearing 120 and cylinder block 102 such that thrust bearing 120 is continuously urged forward by virtue of the restoring force of spring 121. Therefore, even though the clearance created between the side wall of annular groove 105*b* and the front end surface of cylinder block 102 is varied, the clearance is accommodated by spring 121 acting through thrust bearing 120, without selecting the thickness of thrust bearing 120. Furthermore, thrust bearing 120 effectively receives the rearward thrust force generated when drive shaft 105 tends to move rearwardly so that no abnormal abrasion occurs on the front end surface of cylinder block 102 or the side wall of annular ridge 105*b*.

However, since thrust bearing 120 is continuously urged forward by the restoring force of belleville spring 121, the rolling friction between the component parts of thrust bearing 120 is increased, and consequently, the life of thrust bearing 120 is decreased. Furthermore, the provision of a relatively expensive thrust bearing 120 causes an increase in the manufacturing cost of the compressor. And still further, the provision of belleville spring 121 in addition to thrust bearing 120 causes an increase in the number of component parts of the compressor.

In another prior art compressor, Japanese Patent Application No. 60-259776A discloses a variable displacement compressor in which a bearing is disposed within the cylinder block. The cylinder block comprises a bore having a large diameter portion and a small diameter portion with a shoulder therebetween. The bearing is disposed in the large diameter portion such that a portion of the outer race extends radially beyond the shoulder while another portion of the outer race does not extend beyond the shoulder.

During assembly of the '776 compressor, if a rearwardly directed force is applied to the bearing through the small diameter portion of the bore so that the bearing snugly engages the end of the drive shaft, an uneven distribution of force is likely applied to the outer race. This is due to the bore configuration whereby only a portion of the outer race extends beyond the shoulder. Consequently, these nonuniform forces could damage the bearing and lead to its premature failure.

SUMMARY OF THE INVENTION

Accordingly, it is an object of the present invention to provide a bearing mechanism which is fixedly disposed by an improved method within a bore formed through a cylinder block, thereby effectively receiving and compensating for the axial and radial forces acting on a drive shaft without providing an axial position adjusting element, such as a washer, for adjusting the axial position of the drive shaft.

A slant plate type compressor, such as a wobble plate type compressor, includes a compressor housing which encloses a crank chamber, a suction chamber and a discharge chamber therein. The compressor housing comprises a cylinder block having a plurality of cylinders and a piston slidably fitted within each of the cylinders. A drive mechanism is coupled to the pistons for reciprocating the pistons within the cylinders. The drive mechanism includes a drive shaft rotatably supported in the housing. A coupling mechanism is provided for drivingly coupling the pistons with the drive shaft and for converting rotary motion of the drive shaft into reciprocating motion of the pistons. The coupling mechanism includes a slant plate having a surface disposed at an inclined angle relative to a plane perpendicular to the axis of the drive shaft. The inclined angle changes in response to a change in pressure in the crank chamber to thereby change the capacity of the compressor. A communication path links the crank chamber with the suction chamber. A valve control mechanism controls the opening and closing of the communication path in order to cause a change in pressure in the crank chamber, and thus, the change in the capacity of the compressor.

The drive shaft includes a small diameter portion extending from one end thereof so that an annular ridge is formed at the one end of the drive shaft. The small diameter portion of the drive shaft is rotatably supported in a bore formed through the cylinder block by a bearing, such as a radial ball bearing. The radial ball bearing includes an outer annular ring, an inner annular ring and a plurality of rolling elements, such as ball elements rollingly disposed between the outer and inner annular rings. The bearing receives both the axial and radial forces acting on the drive shaft through the outer and inner annular rings and the ball elements.

An outer peripheral surface of the outer annular ring of the bearing frictionally engages an inner peripheral wall of the bore. The inner ring slidably receives the small diameter portion of the drive shaft therethrough and one end of the inner annular ring is in contact with the annular ridge of the drive shaft.

FIGS. *7a–7c* are sectional views illustrating a method of fixedly disposing a radial ball bearing between an outer peripheral surface of an inner rear end portion of a drive shaft and an inner peripheral wall of a front end portion of a central bore formed through a cylinder block.

Figure 8:
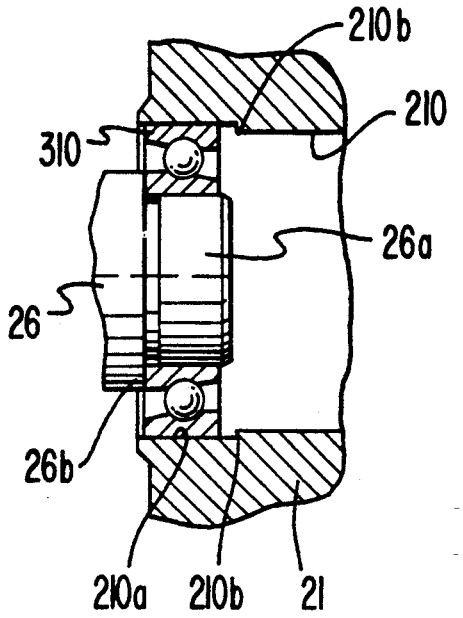

FIG. 8 is a sectional view illustrating a relevant part of a wobble plate type compressor with a variable displacement mechanism in accordance with a second embodiment of the present invention.

Figure 9:
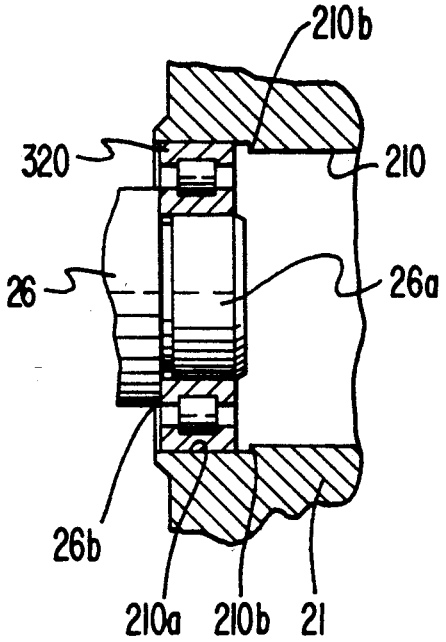

FIG. 9 is a sectional view illustrating a relevant part of a wobble plate type compressor with a variable displacement mechanism in accordance with a third embodiment of the present invention.

Figure 10:
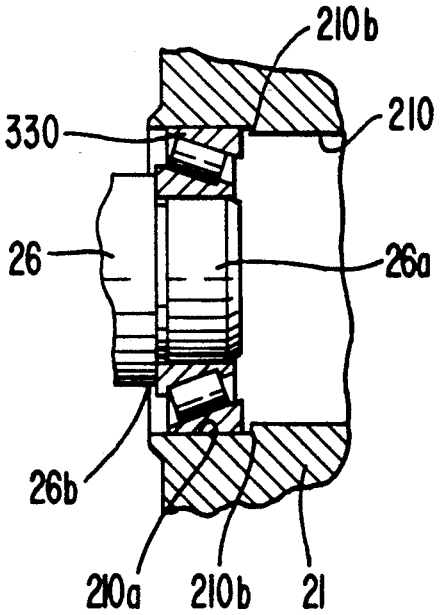

FIG. 10 is a sectional view illustrating a relevant part of a wobble plate type compressor with a variable displacement mechanism in accordance with a fourth embodiment of the present invention.

DETAILED DESCRIPTION OF THE PREFERRED EMBODIMENTS

Figure 1:
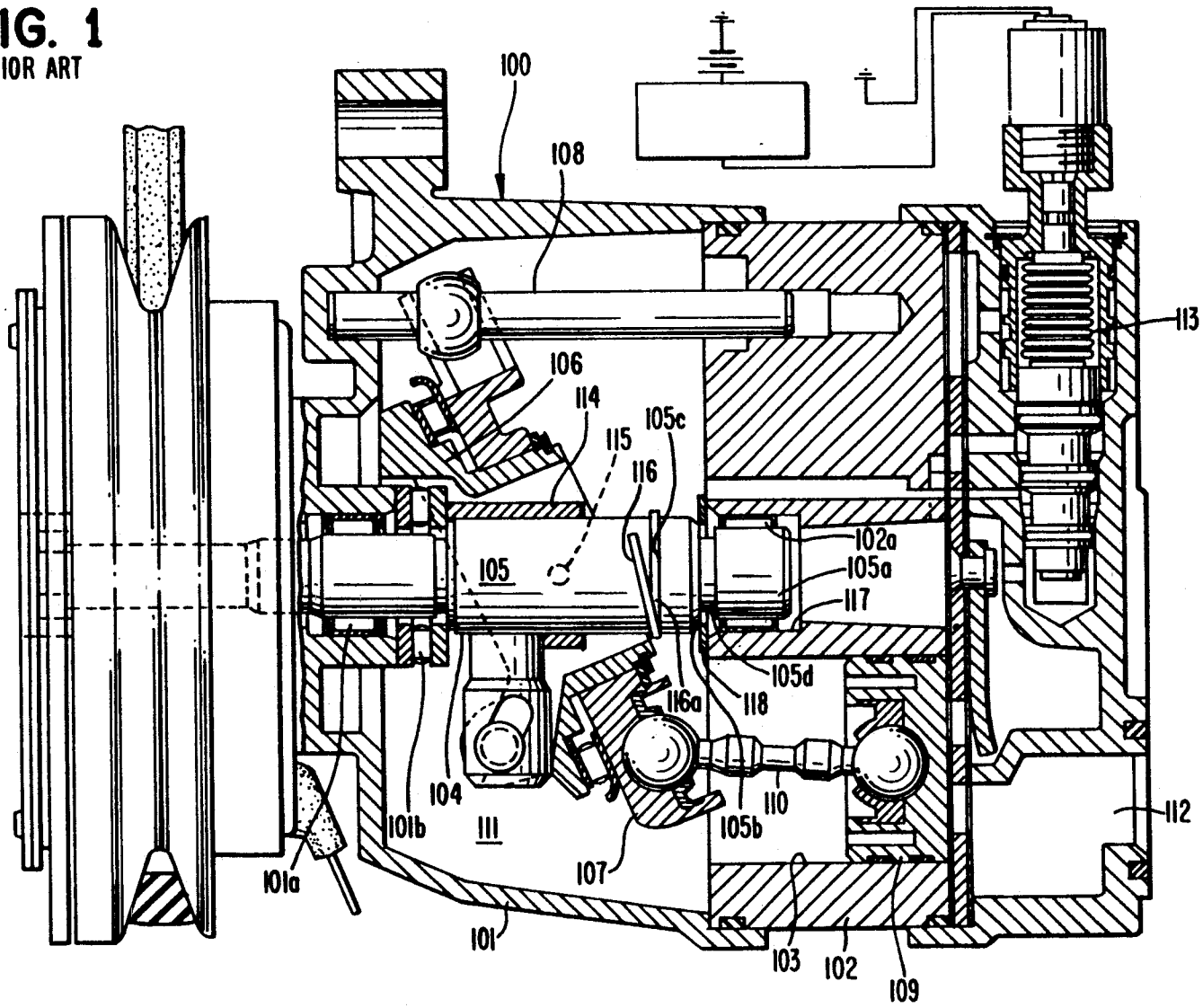
FIG. 1 PRIOR ART
FIG. 1 is a longitudinal sectional view of a wobble plate type compressor with a variable displacement mechanism in accordance with one prior art embodiment.
Figure 3:
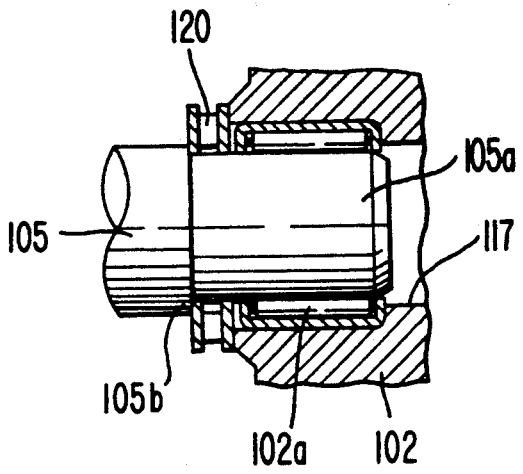
FIG. 3 (PRIOR ART)
FIG. 3 is a sectional view of a relevant part of a wobble plate type compressor with a variable displacement mechanism in accordance with another prior art embodiment.
Figure 2:
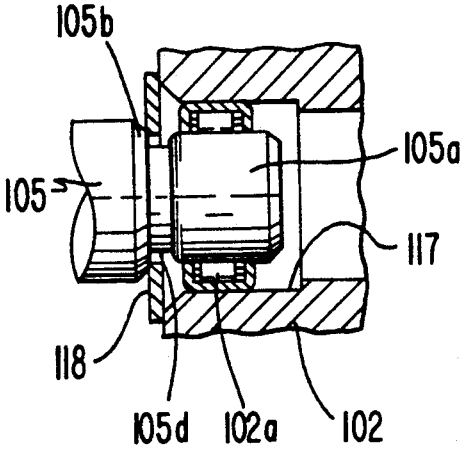
FIG. 2 (PRIOR ART)
FIG. 2 is a sectional view of a relevant part of the compressor shown in FIG. 1.
Figure 4:
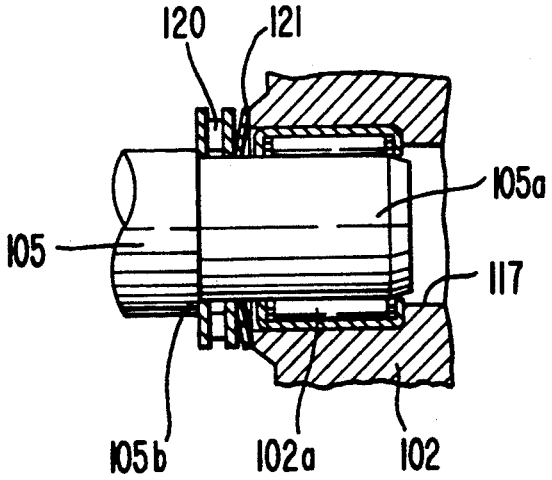
FIG. 4 (PRIOR ART)
FIG. 4 is a sectional view of a relevant part of a wobble plate type compressor with a variable displacement mechanism in accordance with still another prior art embodiment.
Figure 5:
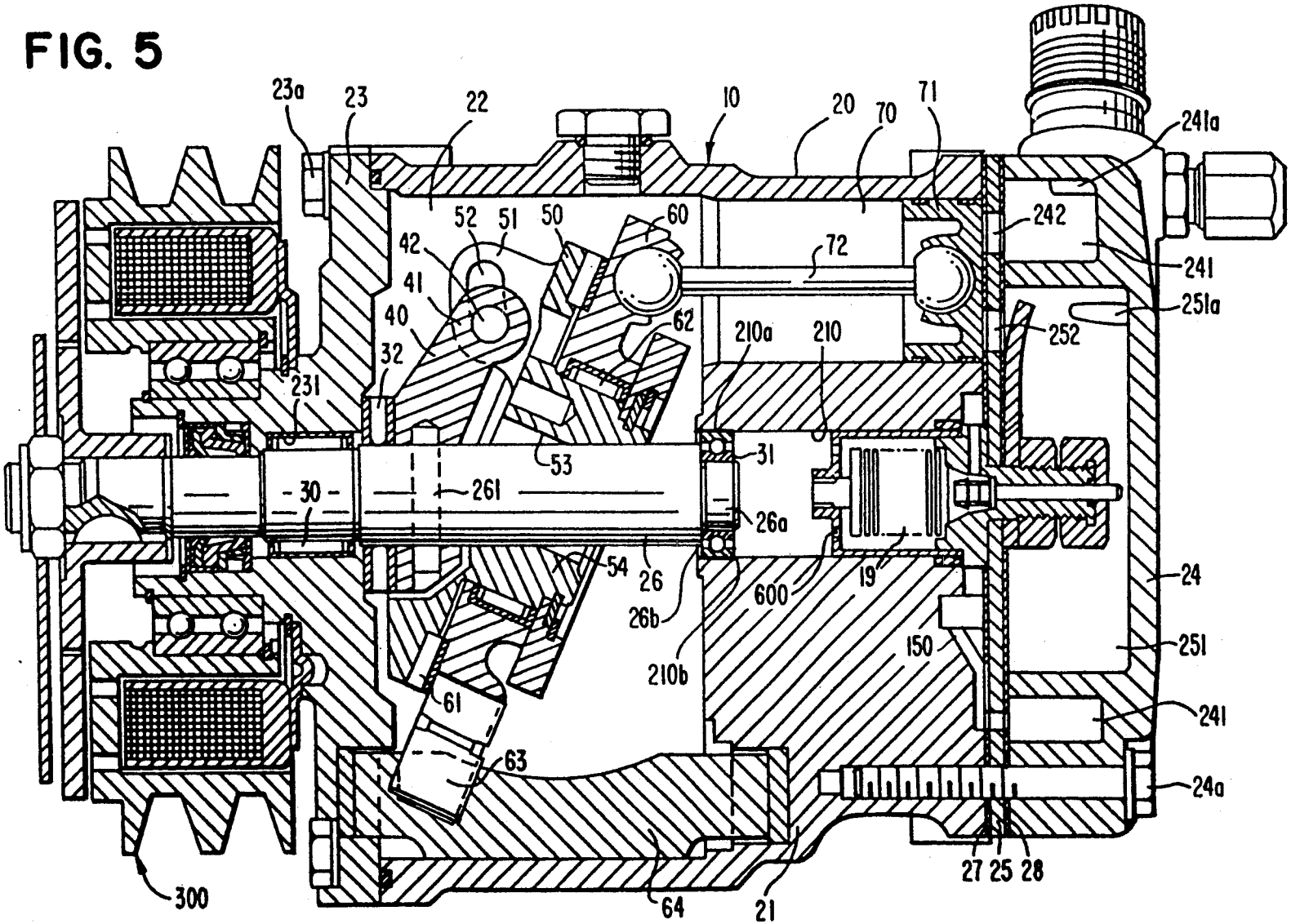
FIG. 5 is a longitudinal sectional view of a wobble plate type compressor with a variable displacement mechanism in accordance with a first embodiment of the present invention.

With reference to FIG. 5, the construction of wobble plate type compressor 10 in accordance with a first embodiment of the present invention is shown. For purposes of explanation only, the left side of the figure will be referenced as the forward end or front and the right side of the figure will be referenced as the rearward end.

Compressor 10 includes cylindrical housing assembly 20 including cylinder block 21, front end plate 23 disposed at one end of cylinder block 21, crank chamber 22 formed between cylinder block 21 and front end plate 23, and rear end plate 24 disposed at the opposite end of cylinder block 21. Front end plate 23 is mounted on the open forward end of cylinder block 21 by a plurality of bolts 23*a*, thus enclosing crank chamber 22 therein. Rear end plate 24 is mounted on cylinder block 21 at its opposite end by a plurality of bolts 24*a*. Valve plate 25 is located between rear end plate 24 and cylinder block 21. Opening 231 is centrally formed in front end plate 23. Drive shaft 26 is supported by bearing 30 disposed in opening 231. Drive shaft 26 includes small diameter portion 26*a* which is integral with and extends from an rear end of drive shaft 26, thereby forming annular ridge 26*b* at the rear end of drive shaft 26. Central bore 210 extends through cylinder block 21 to a forward end surface of cylinder block 21. Small diameter portion 26*a* of drive shaft 26 is rotatably supported by bearing 31 disposed within central bore 210. The relationship between small diameter portion 26*a* of drive shaft 26, bearing 31 and central bore 210 will be described later in detail. A valve control mechanism 19 may also be disposed in bore 210 to the rear of drive shaft 26.

Cam rotor 40 is fixed on drive shaft 26 by pin member 261 and rotates with shaft 26. Thrust needle bearing 32 is disposed between the inner axial rear end surface of front end plate 23 and the adjacent forward axial end surface of cam rotor 40. Cam rotor 40 includes arm 41 having pin member 42 extending therefrom. Slant plate 50 is disposed about drive shaft 26 and includes opening 53 through which drive shaft 26 passes.

The details of opening 53 are described in U.S. Pat. No. 4,846,049 to Terauchi. As relevant to the present invention, Terauchi '049 discloses that the maximum and minimum slant angles of slant plate 50 are determined by the configuration of opening 53. Slant plate 50 is disposed adjacent cam rotor 40.

Slant plate 50 includes arm 51 having slot 52 and boss 54. Cam rotor 40 and slant plate 50 are connected by pin member 42, which is inserted in slot 52 to create a hinged joint. Pin member 42 is slidable within slot 52 to allow adjustment of the angular position of slant plate 50 with respect to the longitudinal axis of drive shaft 26.

When slant plate 50 tends to move to an angular position which is smaller than the minimum allowable slant angle, a rearward force acting on drive shaft 26 is generated by virtue of the excessive friction between a part of the inner wall of opening 53 and a part of the outer peripheral surface of drive shaft 26. When the rearward force generated by the excessive friction between the inner wall of opening 53 and the outer peripheral surface of drive shaft 26 becomes greater than the forward force generated by the gas pressure reaction force in later-mentioned cylinder chambers 70, drive shaft 26 tends to move rearwardly.

Wobble plate 60 is mounted about boss 54 of slant plate 50 by bearings 61 and 62 so that slant plate 50 is rotatable with respect thereto. Rotational motion of slant plate 50 causes nutational motion of wobble plate 60. Fork-shaped slider 63 is attached to the outer peripheral end of wobble plate 60 and is slidably mounted on sliding rail 64 held between front end plate 23 and cylinder block 21. Fork-shaped slider 63 prevents rotation of wobble plate 60 so that wobble plate 60 reciprocates along rail 64 when cam rotor 40 and slant plate 50 rotate. Cylinder block 21 includes a plurality of peripherally located cylinder chambers 70 in which pistons 71 reciprocate. Each piston 71 is connected to wobble plate 60 at a peripheral location by a corresponding connecting rod 72. Nutational motion of wobble plate 60 causes pistons 71 to reciprocate in cylinders 70 to compress the refrigerant therein.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharged ports 252 linking discharge chamber 251 with respective cylinders 70. Suction ports 242 and discharge ports 252 may be provided with suitable reed valves as described in U.S. Pat. No. 4,011,029 to Shimizu.

Suction chamber 241 includes inlet portion **241*a* which is connected to an evaporator of the external cooling circuit (not shown). Discharge chamber 251 includes outlet portion 251*a* which is connected to a condenser of the cooling circuit (not shown). Gaskets 27 and 28 are located between cylinder block 21 and the front surface of valve plate 25, and the rear surface of valve plate 25 and rear end plate 24, respectively, to seal the mating surfaces of cylinder block 21, valve plate 25 and rear end plate 24**.

Communication path 600 links crank chamber 22 and suction chamber 241 and includes central bore 210 and passageway 150. Valve control mechanism 19 controls the opening and closing of communication path 600 in order to vary the capacity of the compressor, as disclosed in U.S. Pat. No. 4,960,367 to Terauchi.

During operation of compressor 10, drive shaft 26 is rotated by the engine of the vehicle through electromagnetic clutch 300. Cam rotor 40 is rotated with drive shaft 26, rotating slant plate 50 as well, and causing wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion **241*a*, flows into each cylinder 70 through suction ports 242 and is compressed therein. The compressed refrigerant gas is discharged from each cylinder 70 through discharge ports 252, into discharge chamber 251, and therefrom into the cooling circuit through outlet portion 251*a***.

The capacity of compressor 10 may be adjusted to maintain a constant pressure in suction chamber 241 in response to a change in the heat load of the evaporator, or a change in the rotating speed of the compressor. The capacity of the compressor is adjusted by changing the angle of slant plate 50 with respect to a plane perpendicular to the axis of drive shaft 26. The angle is dependent upon the crank chamber pressure. An increase in the crank chamber pressure decreases the slant angle of slant plate 50 and wobble plate 60, decreasing the capacity of the compressor. A decrease in the crank chamber pressure increases the angle of slant plate 50 and wobble plate 60 and thus increases the capacity of the compressor.

Valve control mechanism 19 acts in response to the crank chamber pressure, such that the position of the mechanism is modified according to the discharge pressure, to control the fluid communication link between the crank and suction chambers, to adjust the crank chamber pressure and thereby change the slant angle of slant plate 50 and vary the operating capacity of the compressor. Of course other types of valve control mechanisms may be used in compressors according to the present invention, or alternatively, a fixed capacity compressor may also be utilized with the bearing member of the present invention.

Figure 6:
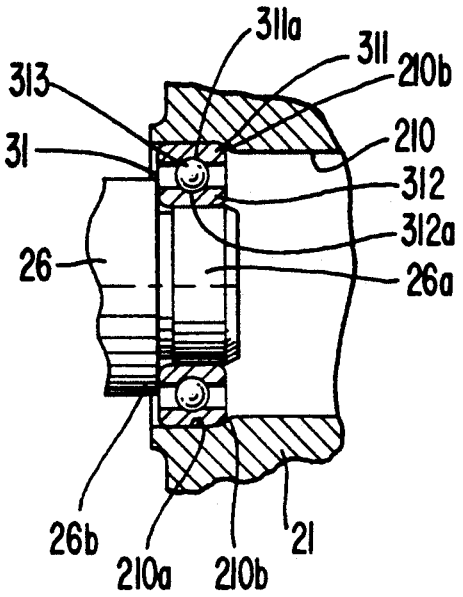
FIG. 6 is a sectional view of a relevant part of the compressor shown in FIG. 5.

Referring to FIG. 6 additionally, central bore 210 includes large diameter portion **210*a* which is formed at the front end portion thereof and thereby forms annular ridge 210*b* at the rear end of large diameter portion 210*a*. Radial ball bearing 31 includes outer annular ring 311, inner annular ring 312 and a plurality of ball elements 313 rollingly disposed at equal intervals between outer and inner annular rings 311 and 312 by a holding element (not shown). Annular groove 311*a*, of which a sectional view is arcuate, is formed at an inner peripheral surface of annular ring 311. Annular groove 312*a*, of which a sectional view is also arcuate, is formed at an outer peripheral surface of inner annular ring 312. Ball elements 313 are received in respective annular grooves 311*a* and 312*a*. An outer diameter of outer annular ring 311 is designed to be slightly smaller than a diameter of large diameter portion 210*a* of central bore 210, and an inner diameter of inner annular ring 312 is designed to be slightly greater than a diameter of small diameter portion 26*a* of drive shaft 26**.

Radial ball bearing 31 is fixedly disposed within large diameter portion **210*a* of central bore 210 between the front end surface of cylinder block 21 and the side wall of annular ridge 210*b* by, for example, forcible insertion. Small diameter portion 26*a* of drive shaft 26 is disposed within radial ball bearing 31 to obtain a clearance fit and slight slidability while annular ridge 26*b* is maintained in contact with a front end of inner annular ring 312 of radial ball bearing 31**.

In the construction of radial ball bearing 31, both the rearward and radial forces acting upon drive shaft 26 influence the movement of inner annular ring 312 resulting in a front portion of annular groove **312*a* of inner annular ring 312 coming in contact with a front lower portion of ball elements 313 while a rear upper portion of ball elements 313 comes in contact with a rear portion of annular groove 311*a* of outer annular ring 311. Thus, both the rearward and radial forces acting on drive shaft 26 are effectively received and compensated for by radial ball bearing 31**.

Referring to FIGS. *7a–7c*, a method of disposing radial ball bearing 31 within large diameter portion **210*a* of central bore 210 and a method of disposing small diameter portion 26*a* of drive shaft 26 within radial ball bearing 31** are illustrated.

First, referring to FIG. *7a*, radial ball bearing 31 is forcibly inserted into large diameter portion **210*a* of central bore 210 from the front side of central bore 210 by using a rearwardly moving cylindrical member 400, that has a rear end in contact with a front end of both outer and inner annular rings 311 and 312, until a rear end of outer annular ring 311 comes into contact with annular ridge 210***b*.

Figure 7A:
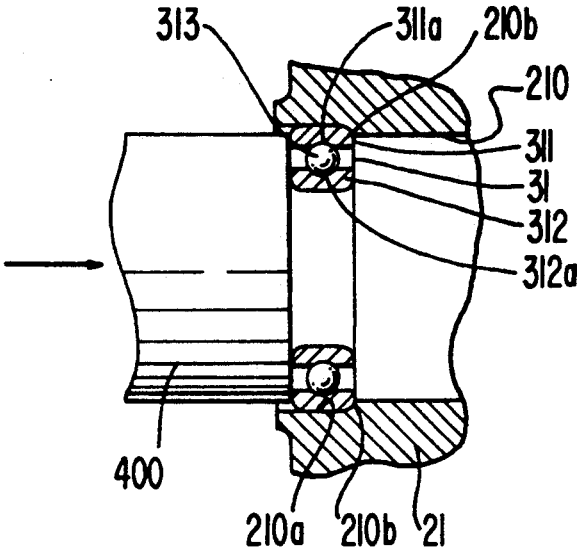
Figure 7B:
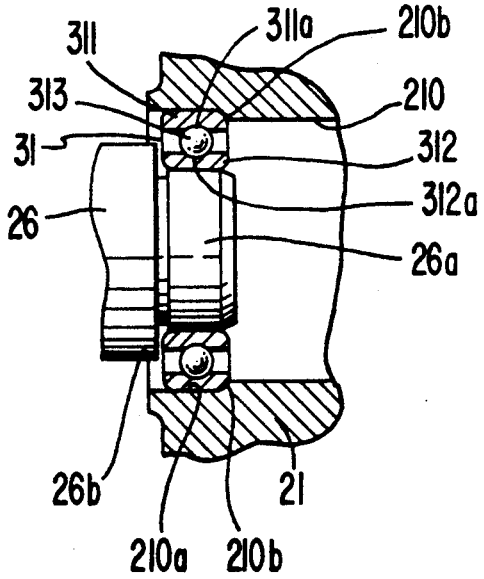

Next, referring to FIG. 7*b*, small diameter portion 26*a* of drive shaft 26 is slidably inserted into radial ball bearing 31 until the rear end surface of front end plate 23 comes into contact with the front end surface of cylindrical housing assembly 20. Furthermore, an axial length of large diameter portion 210*a* of central bore 210 is designed so as to create a clearance between the side wall of annular ridge 26*b* of drive shaft 26 and the front end surface of radial ball bearing 31 while the rear end of outer annular ring 311 is in contact with annular ridge 210*b*.

Figure 7C:
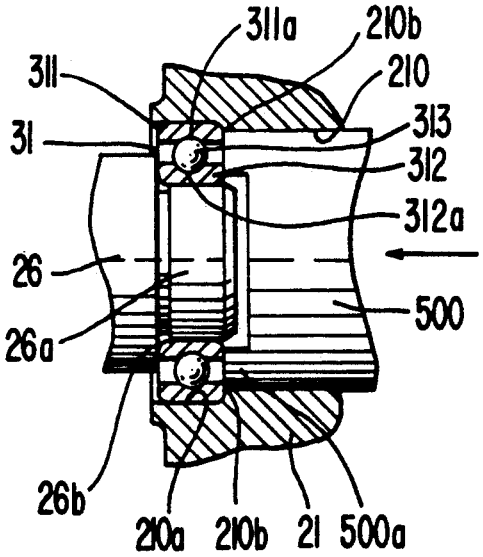

Finally, referring to FIG. 7*c*, radial ball bearing 31 is forcibly slid forward by using a cylindrical member 500, having an annular front end 500*a* in contact with the rear end of each of outer and inner annular rings 311 and 312, and moving cylindrical member 500 forward until the front end of inner annular ring 312 comes in contact with the side wall of annular ridge 26*b* of drive shaft 26. Even though radial ball bearing 31 is forcibly slid forward, the outer peripheral surface of outer annular ring 311 of bearing 31 and the inner peripheral wall of large diameter portion 210*a* of central bore 210 are sufficiently frictionally engaged with each other so that the rearward movement of drive shaft 26 is effectively prevented by bearing 31.

As described above for the present invention, both the rearward and radial forces acting upon drive shaft 26 are effectively received and compensated for by the bearing element fixedly disposed within the central bore of the cylinder block, without having to provide an axial position adjusting element such as a washer having various thicknesses for adjusting the axial position of the drive shaft.

FIG. 8 illustrates a second embodiment of the present invention. In the second embodiment, radial ball bearing 31 of the first embodiment is replaced with angular contact ball bearing 310.

FIG. 9 illustrates a third embodiment of the present invention. In the third embodiment, radial ball bearing 31 of the first embodiment is replaced with collared cylindrical roller bearing 320.

FIG. 10 illustrates a fourth embodiment of the present invention. In the fourth embodiment, radial ball bearing 31 of the first embodiment is replaced with circular cone roller bearing 330.

In the second through fourth embodiments of the present invention, since each of bearings 310, 320 and 330 does not have a symmetrical body with respect to a center plane perpendicular to the axis of the bearing, each of the bearings is forcibly inserted into large diameter portion 210*a* of central bore 210 so as to maintain one axial end thereof facing the side wall of annular ridge 26*a* of drive shaft 26. The method of disposing each of the bearings within large diameter portion 210*a* of central bore 210 and the method of disposing small diameter portion 26*a* of drive shaft 26 within each of the bearings are similar to the methods of the first embodiment, other than the above-mentioned difference, so an explanation thereof is omitted. Furthermore, the result in each of the embodiments is similar to the result of the first embodiment so that an explanation thereof is also omitted.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a slant plate type compressor including a compressor housing enclosing a crank chamber, a suction chamber and a discharge chamber therein, said compressor housing comprising a cylinder block having a plurality of cylinders, a piston slidably fitted within each of said cylinders and drive means coupled to said pistons for reciprocating said pistons within said cylinders, said drive means including a drive shaft rotatably supported in said housing and coupling means for drivingly coupling said pistons with said drive shaft and for converting rotary motion of said drive shaft into reciprocating motion of said pistons, said coupling means including a slant plate having a surface disposed at an inclined angle relative to a plane perpendicular to an axis of said drive shaft, the inclined angle changing in response to a change in pressure in said crank chamber to thereby change the capacity of said compressor, a communication path linking said crank chamber with said suction chamber, a valve control mechanism controlling the opening and closing of said communication path to cause a change in pressure in said crank chamber, said drive shaft including a small diameter portion extending from one end thereof so that an annular ridge is formed at said one end of said drive shaft, said small diameter portion of said drive shaft rotatably supported by bearing means in a bore formed through said cylinder block, the improvement comprising:

said bore in said cylinder block comprising a large diameter portion having a first longitudinal axis and a small diameter portion having a second longitudinal axis, wherein said small diameter portion is spaced from said large diameter portion and the longitudinal axis of said small diameter portion is concentric with the longitudinal axis of said large diameter portion;

said bearing means including an outer annular ring, an inner annular ring and a plurality of rolling elements rollingly disposed between said outer and inner annular rings, said bearing means receiving both the axial and radial forces acting on said drive shaft through said outer and inner annular rings and said rolling elements; and an outer peripheral surface of said outer annular ring of said bearing means frictionally engaging an inner peripheral wall of said bore, said inner ring slidably receiving said small diameter portion of said drive shaft therewithin while one end of said inner annular ring is in contact with a side wall of said annular ridge of said drive shaft.

2. The slant plate type compressor of claim 1 wherein said bearing means comprises a radial ball bearing.

3. The slant plate type compressor of claim 1 wherein said bearing means comprises an angular contact ball bearing.

4. The slant plate type compressor of claim 1 wherein said bearing means comprises a collared cylindrical roller bearing.

5. The slant plate type compressor of claim 1 wherein said bearing means comprises a circular cone roller bearing.

6. A slant plate type compressor comprising:

a compressor housing enclosing a crank chamber, a suction chamber and a discharge chamber;

said compressor housing including a cylinder block having a plurality of cylinders formed therethrough, a piston slidably fitted within each of said cylinders, drive means coupled to said pistons for reciprocating said pistons within said cylinders, and a bore formed through said cylinder block;

said drive means including a drive shaft rotatably supported in said housing and coupling means for drivingly coupling said drive shaft to said pistons such that rotary motion of said drive shaft is converted into reciprocating motion of said pistons;

said coupling means including a slant plate having a surface disposed at an adjustable inclined angle relative to a plane perpendicular to said drive shaft;

a front end plate disposed on one end of said cylinder block and a rear end plate disposed on the other end of said cylinder block;

a passageway formed in said housing and linking said crank chamber and said suction chamber in fluid communication;

capacity control means for varying the capacity of said compressor by controlling the opening and closing of said passageway and thereby adjusting the inclined angle of said slant plate;

said drive shaft including a main drive shaft portion, a smaller diameter end portion extending from one end of said main drive shaft portion, and an annular ridge formed on said one end between said main drive shaft portion and said smaller diameter end portion;

a bearing member rotatably supporting said smaller diameter end portion of said drive shaft in said bore formed through said cylinder block;

said bearing member comprising an outer ring, an inner annular ring, and a plurality of rolling elements disposed between said outer and inner annular rings such that said bearing member effectively absorbs both axial and radial forces acting on said drive shaft; and said bore in said cylinder block comprising a large diameter portion having a first longitudinal axis and a small diameter portion having a second longitudinal axis, wherein said small diameter portion is spaced from said large diameter portion and the longitudinal axis of said small diameter portion is concentric with the longitudinal axis of said large diameter portion.

7. The slant plate type compressor of claim 6 wherein an outer peripheral surface of said outer annular ring of said bearing member frictionally engages an inner wall of said bore formed through said cylinder block.

8. The slant plate type compressor of claim 6 wherein said inner annular ring of said bearing member slidably receives therethrough said smaller diameter end portion of said drive shaft.

9. The slant plate type compressor of claim 8 wherein an end surface of said inner annular ring of said bearing member contacts an end surface of said annular ridge.

10. The slant plate type compressor of claim 6 wherein said plurality of rolling elements are disposed at equal intervals between said outer and inner annular rings.

11. The slant plate type compressor of claim 6 wherein said outer annular ring includes a first annular groove and said inner annular ring includes a second annular groove.

12. The slant plate type compressor of claim 11 wherein said rolling elements are disposed in said first and second annular grooves between said inner and outer annular rings.

13. The slant plate type compressor of claim 6 wherein said bearing member comprises a radial ball bearing.

14. The slant plate type compressor of claim 6 wherein said bearing member comprises an angular contact ball bearing.

15. The slant plate type compressor of claim 6 wherein said bearing member comprises a collared cylindrical roller bearing.

16. The slant plate type compressor of claim 6 wherein said bearing member comprises a circular cone roller bearing.

17. A slant plate type compressor comprising:

a compressor housing enclosing a crank chamber, a suction chamber and a discharge chamber;

the compressor housing including a cylinder block having a plurality of cylinders formed therethrough, a piston slidably fitted within each of the cylinders, drive means coupled to the pistons for reciprocating the pistons within the cylinders, and a bore formed through the cylinder block;

the drive means including a draft shaft rotatably supported in the housing and coupling means for drivingly coupling the drive shaft to the pistons such that rotary motion of the drive shaft is converted into reciprocating motion of the pistons;

the coupling means including a slant plate having a surface disposed at an adjustable inclined angle relative to a plane perpendicular to the drive shaft;

a front end plate disposed on one end of the cylinder block and a rear end plate disposed on the other end of the cylinder block;

the drive shaft including a main drive shaft portion, a smaller diameter end portion extending from one end of the main drive shaft portion, and an annular ridge formed on the one end between the main drive shaft portion and the smaller diameter end portion;

a bearing member rotatably supporting the smaller diameter end portion of the drive shaft in the bore formed through the cylinder block;

the bearing member comprising an outer annular ring, an inner annular ring, and a plurality of rolling elements disposed between the outer and inner annular rings such that the bearing member effectively absorbs both axial and radial forces acting on the drive shaft, and wherein the outer annular ring includes a first annular groove and the inner annular ring includes a second annular groove; and said bore in said cylinder block comprising a large diameter portion having a first longitudinal axis and a small diameter portion having a second longitudinal axis, wherein said small diameter portion is spaced from said large diameter portion and including a shoulder therebetween, said bearing member supported in said large diameter portion such that a gap is formed between said shoulder and said bearing, and wherein the longitudinal axis of said small diameter portion is concentric with the longitudinal axis of said large diameter portion.

18. The slant plate type compressor of claim 17 wherein said rolling elements are disposed in said first and second annular grooves between said inner and outer annular rings.

19. A slant type compressor comprising:

a compressor housing enclosing a crank chamber, a suction chamber and a discharge chamber;

the compressor housing including a cylinder block having a plurality of cylinders formed therethrough, a piston slidably fitted within each of the cylinders, drive means coupled to the pistons for reciprocating the pistons within the cylinders, and a bore formed through the cylinder block;

the drive means including a draft shaft rotatably supported in the housing and coupling means for drivingly coupling the drive shaft to the pistons such that rotary motion of the drive shaft is converted into reciprocating motion of the pistons;

the coupling means including a slant plate having a surface disposed at an adjustable inclined angle relative to a plane perpendicular to the drive shaft;

a front end plate disposed on one end of the cylinder block and a rear end plate disposed on the other end of the cylinder block;

the drive shaft including a main drive shaft portion, a smaller diameter end portion extending from one end of the main drive shaft portion, and an annular ridge formed on the one end between the main drive shaft portion and the smaller diameter end portion;

a bearing member rotatably supporting the smaller diameter end portion of the drive shaft in the bore formed through the cylinder block;

the bearing member comprising an outer annular ring, an inner annular ring, and a plurality of rolling elements disposed between said outer and inner annular rings, said outer annular ring having an outer periphery in contact with said bore and an inner periphery opposing said outer periphery; and said bore in said cylinder block comprising a large diameter portion and a small diameter portion, wherein the entire inner periphery of said outer annular ring radially inwardly extends beyond said small diameter portion of said cylinder block.

* * * * *